US008469553B2

(12) United States Patent
Damman

(10) Patent No.: US 8,469,553 B2
(45) **Date of Patent: *Jun. 25, 2013**

(54) DEVICE FOR ALLOWING HAND TRANSPORT OF A JACK-O-LANTERN

(76) Inventor: Kirk A. Damman, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/542,501

(22) Filed: Jul. 5, 2012

(65) Prior Publication Data

US 2012/0268921 A1 Oct. 25, 2012

Related U.S. Application Data

(63) Continuation of application No. 12/902,977, filed on Oct. 12, 2010, now Pat. No. 8,220,972, which is a continuation of application No. 11/937,333, filed on Nov. 8, 2007, now Pat. No. 7,832,906.

(60) Provisional application No. 60/864,868, filed on Nov. 8, 2006.

(51) Int. Cl.
*F21V 3/00* (2006.01)
*F21V 5/00* (2006.01)

(52) U.S. Cl.
USPC ..... 362/311.13; 362/249.02; 362/311.02; 362/399; 362/457; 362/122

(58) Field of Classification Search
USPC ..... 362/311.13, 122, 249.02, 311.02, 362/399, 457
See application file for complete search history.

(56) References Cited

U.S. PATENT DOCUMENTS 7,832,906 B2 * 11/2010 Damman ..... 362/311.13

* cited by examiner

*Primary Examiner* — Stephen F Husar
*Assistant Examiner* — James Cranson, Jr.
(74) *Attorney, Agent, or Firm* — Lewis, Rice & Fingersh, L.C.

(57) ABSTRACT

A transport device used to connect to a jack-o-lantern which serves to both provide for an illumination source and an easy manner in which to transport the jack-o-lantern when it is illuminated. There are also provided related systems and methods of use of the device. The result provides for a jack-o-lantern to be easily transported as a lantern or costume prop.

18 Claims, 3 Drawing Sheets

DEVICE FOR ALLOWING HAND TRANSPORT OF A JACK-O-LANTERN

CROSS REFERENCE TO RELATED APPLICATION(S)

This application is a Continuation of U.S. Utility patent application Ser. No. 12/902,977, filed Oct. 12, 2010, and now U.S. Pat. No. 8,220,972, which is in turn a Continuation of U.S. Utility patent application Ser. No. 11/937,333, filed Nov. 8, 2007 and now U.S. Pat. No. 7,832,906, which claims benefit of U.S. Provisional Patent Application 60/864,868 filed Nov. 8, 2006. The entire disclosure of all of these documents is herein incorporated by reference.

BACKGROUND

1. Field of the Invention

The invention relates to a transport device allowing hand transport of a jack-o-lantern or other carved and illuminated vegetable.

2. Description of the Related Art

The jack-o-lantern is one of the most recognized symbols of Halloween and appears in all sorts of forms. Jack-o-lanterns are traditionally formed by the carving of a face, or other image, into the outer shell of a pumpkin (or occasionally another vegetable or fruit such as a squash, guard, or melon) which has been hollowed out to remove the seeds and internal structure resulting in a generally hollow shell. The carving may comprise removing portions of the pumpkin shell to form large holes, simply pushing a series of small pin holes through the shell, or more elaborate methodologies.

A lighting source (traditionally a candle, although many forms of battery powered lights such as LED's have been used) is then placed into the hollow pumpkin shell and activated. The illumination of the lighting source both generally lights up the shell creating a glowing orb-like shape, and can escape through the holes formed by the carving of the shell to give an eerie glowing appearance to the resultant artwork. If the carving is of a face, this will generally result in the appearance of a glowing head suitable for the ambiance of Halloween.

While the appearance of a jack-o-lantern has been copied in a myriad of different ways including on paper lanterns, plastic totes, and ceramic lanterns to provide for alternative mechanisms and display pieces without the need to actually carve a pumpkin, the traditional carved form still is often seen as having the best appearance. The fibrous plant matter of the pumpkin along with its natural orange color often provide for an eerier and more enjoyable appearance than molded structures of ceramic or paper-mache. Further, the process of constructing a jack-o-lantern is often also a holiday tradition for many families and decoration can be selected for particular purpose and to show artistic skill.

While the jack-o-lantern in its traditional form, therefore, often provides for a unique artwork which can not adequately be reproduced by more modern, and less transitory, reproductions, the traditional jack-o-lantern has one major limitation on Halloween night. In particular, it is generally confined to resting on a surface where it is displayed because it is not easy to transport by hand. It is therefore a static display piece as opposed to a custom accessory or actual "lantern." Further, its static nature can make it a target for vandals wishing to cause mischief.

Because the necessity of having to cut an access into the jack-o-lantern to remove the interior structure and seeds, the jack-o-lantern generally includes a lid to the jack-o-lantern which was formed around the stem or otherwise at the top of the jack-o-lantern. In most cases, since a portion of the pumpkin structure surrounding the stem is now separable from the remaining shell, the jack-o-lantern can generally not be carried by the stem. Therefore, it becomes necessary to carry the jack-o-lantern as a spherical ball, such as in the crook of an arm as opposed to in the hand. Such transport is unwieldy over any significant distance, such as may be the case while trick-or-treating, and can also be problematic as it can be tiresome. Still further, concerns about potentially disrupting a light source can make it very difficult to carry the jack-o-lantern while it is illuminated.

Even if the access was made at a point separate from the stem, the jack-o-lantern is relatively unstable in construction due to its lack of internal structure, and parts of its shell being removed or compromised by the act of carving. Further, the stem does not comprise a comfortable handle for transporting the jack-o-lantern in the hand as it is quite rough and can have spines.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein is a handle or hanging support system for use with a carved pumpkin which allows the pumpkin to be both safely illuminated and carried as a lantern in the hand, or hung as a hanging display. The systems, methods and devices, allow for a traditional carved jack-o-lantern, formed by the carving of a pumpkin, gourd, melon, or other plant matter, to be used as a lantern allowing the user to show off their carving skill in a portable display and for a traditional carved jack-o-lantern to be used as part of a costume for trick-or-treating.

It should be noted that an important aspect of the device is that it can be used to transport the traditional carved pumpkin, the device does not utilize an illuminated device which is formed to look like a carved pumpkin, but is instead designed to actually transport a jack-o-lantern comprising carved plant matter.

There is described herein, among other things, a device for the hand transport of a lighted carved shell comprised of plant matter, the device comprising: two plates, each of said plates including a plurality of prongs extending therefrom; a rod, allowing the two plates to be connected together; an illumination device capable of being attached to said rod; and a handle connectable to said rod; wherein said plates are mounted on said rod so that the plurality of prongs on said plates extend toward each other; wherein said illumination device is attached to said rod between said plates; and wherein said handle is attached to said rod at a position which is not between said plates.

In an embodiment of the device, the rod is formed of a plurality of component pieces which are repeatedly connectable and separable, the illumination device may be permanently attached to one of said component pieces.

In an embodiment of the device, the illumination source comprises a bank of Light Emitting Diodes (LEDs).

In an embodiment of the device, the plant matter comprises a pumpkin.

There is also described herein, a method of transporting a lighted carved pumpkin shell, the method comprising: providing a transport device, the device comprising: two plates, each of said plates including a plurality of prongs extending therefrom; a rod, allowing the two plates to be connected together; an illumination device capable of being attached to said rod; and a handle connectable to said rod; providing a carved pumpkin shell; placing said plates on opposing sides of said pumpkin shell so that said prongs extend into said pumpkin shell; holding said rod in a fixed position relative to both of said plates; affixing said handle to one end of said rod; and transporting said pumpkin shell by said handle.

In an embodiment of the method the holding occurs on a first of said plates by having said handle screw onto said rod. The holding may occur on a second of said plates by having a nut screw onto said rod. The nut may have a diameter relatively equal to the diameter of said plate.

In an embodiment of the method, the rod is formed of a plurality of component pieces which are repeatedly connectable and separable, the illumination device may permanently attached to one of said component pieces, and one of said bases is permanently attached to one of said component pieces.

In an embodiment of the device, the illumination source comprises a bank of Light Emitting Diodes (LEDs).

There is also described herein, a lantern formed from a jack-o-lantern, the lantern comprising: a jack-o-lantern; two plates, each of said plates including a plurality of prongs extending therefrom; a rod, allowing the two plates to be connected together; an illumination device capable of being attached to said rod; and a handle connectable to said rod; wherein said plates are mounted on said rod so that the plurality of prongs on said plates extend toward each other and into an exterior surface of said jack-o-lantern; wherein said illumination device is attached to said rod between said plates and within said jack-o-lantern; and wherein said handle is attached to said rod at a position which is not between said plates and can be used to carry said jack-o-lantern by hand.

In an embodiment the jack-o-lantern is formed from a melon, a squash, a gourd, or a pumpkin.

In an embodiment of the device, the rod is formed of a plurality of component pieces which are repeatedly connectable and separable, the illumination device may be permanently attached to one of said component pieces.

In an embodiment of the device, the illumination source comprises a bank of Light Emitting Diodes (LEDs).

In a still further embodiment a nut is attached to said rod at a position which is not between said plates and is on the opposing end of said rod to said handle.

DESCRIPTION OF THE PREFERRED EMBODIMENT(S)

Figure 1:
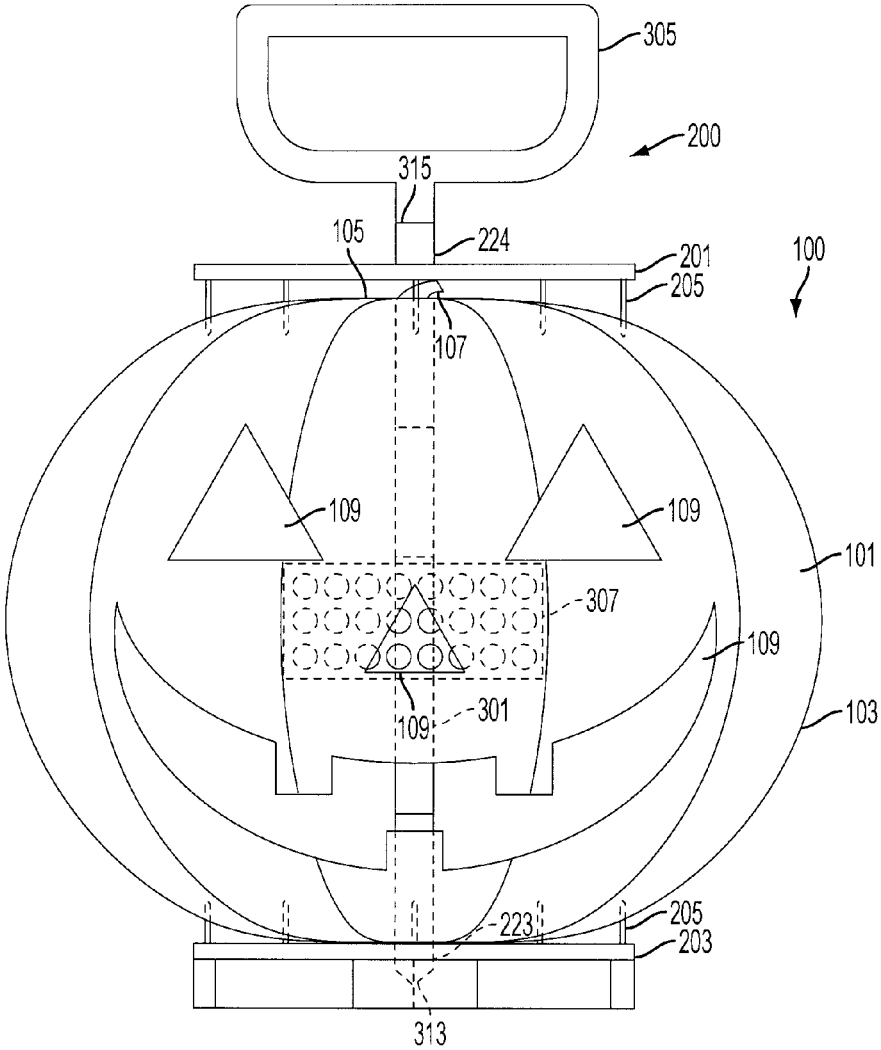
FIG. 1 shows a perspective view of a transport device for carrying a carved vegetable in place about a carved pumpkin or jack-o-lantern.

FIG. 1 provides for a first embodiment of a lantern (100) formed by providing a carved plant such as a pumpkin shell (101) or, more specifically, a jack-o-lantern to which a transport device (200) is connected. The shell (101) includes the main body of the pumpkin (103) and a lid (105) which was cut out to hollow out the pumpkin (101) but is now replaced. The lid will generally be formed so as to be cut from the shell in an area surrounding the stem of the pumpkin. In the depicted embodiment, the pumpkin stem has been cut down to a short stub to get it out of the way of the transport device (200). In an alternative embodiment, the stem may be broken off of the pumpkin to remove it entirely. The pumpkin (101) includes various carved openings (109) which provide for the jack-o-lantern's artistic appearance. While this disclosure will presume the jack-o-lantern is formed of a pumpkin, one of ordinary skill in the art would understand that it may be formed from other plant matter such as, but not limited to, a squash, gourd, or melon.

The pumpkin shell (101) has placed upon it a transport device (200) which is used to provide the pumpkin with additional rigidity, support for maintaining the pumpkin in an upwards orientation, and a handle for carrying the pumpkin shell (101) from above, as well as a fixed illumination device (307) which will not tip or move when the jack-o-lantern is so transported.

Figure 2:
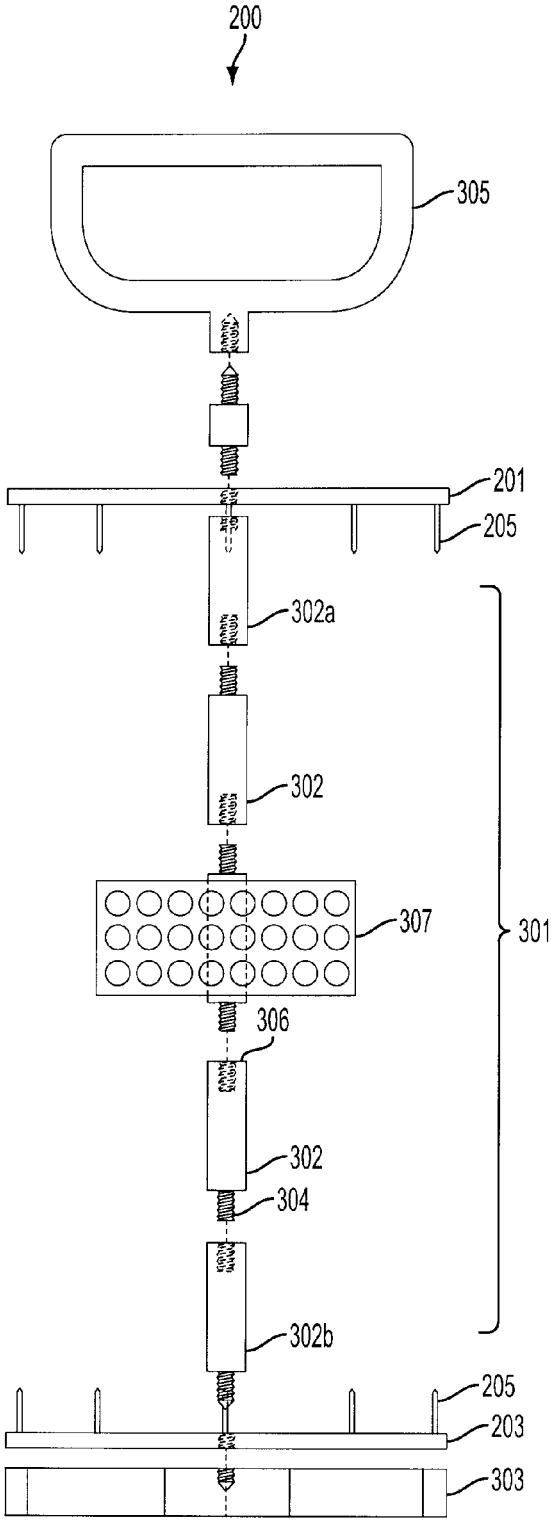
FIG. 2 provides an exploded view of the transport device of FIG. 1 separated from the jack-o-lantern.

The transport device (200) is further depicted in exploded view in FIG. 2 and generally comprises two plates (201) and (203). The plates (201) and (203) may be flat as is shown, or may include curvature to better approximate the outside shape of the base and top of the pumpkin (101). Each of the plates (201) and (203) includes a plurality of prongs (205) which extend generally vertically from the plate (201) or (203). As depicted, on the top plate (201) the prongs (205) extend downward while from the bottom plate (203) they extend upward so that when positioned the prongs are pointed toward each other. The prongs (205) may, in an embodiment, be barbed to keep them affixed to the shell (101) once attached. For practical manufacture, it should be recognized that the two plates (201) and (203) may be constructed identically for ease of manufacturing and simply arranged in the depicted positioning. In the embodiment of FIGS. 1 and 2, each plate (201) and (203) includes a generally centrally placed hole (221) and (223) therethrough.

There is a support rod (301) having two ends (315) and (313) and a length. The support rod (301) will generally be threaded along at least a portion of its length, generally so as to have threads at the sections approaching both ends (315) and (313), however, in an alternative embodiment, the entire length of the support rod (301) may be threaded. In a still further embodiment, as depicted in FIG. 2, the rod (301) may be comprised of a series of smaller rod components (302) which can be attached together to form the support rod (301). As depicted, these will generally comprise components (302) of fixed length, at least some of which (302*a*) and are externally threaded and each of which generally terminate with a male threaded connector (304) on a first end and a female internally threaded connector (306) on a second end. The connectors (304) and (306) will be sized and shaped so that when consecutive components (302) are attached together, the resultant rod (301) presents a relatively uniform external surface.

It is generally preferred that the threads of the connectors (304) and (306) be the same direction to the threads which connect the rod (301) to the nut (303) and handle (305) so that when the rod (301) is rotated to engage those components, the internal connectors (304) and (306) do not unscrew from each other but are actually tightened. In a still further embodiment, other connectors (304) and (306) may be provided to connect the rod pieces (302) together so long as the resultant rod (301) has sufficient strength to not disengage components (302) when the transport device (200) is in use, specifically when the mass of the pumpkin (101) is being supported on the lower plate (203) and suspended by the handle (305).

Either end (313) or (315) of the rod (301) may be sharpened to a point (308) or otherwise be designed so as to be able to penetrate the pumpkin shell (101). At a point generally between the two ends (313) and (315) of the rod (301) there may be attached a light source (307). The light source (307) may be any type of illumination source but will generally be a self-contained panel of LEDs (as shown) or similar illumination devices capable of running from standard battery power. The light source (307) may be directionally oriented and affixed to the rod (301) so as to project light toward the openings (109) carved in the pumpkin (101) or may be diffuse. The light source (307) may also include lighting effects to simulate the appearance of flame or simulate other types of light sources to provide for effects. The light source (307) may be removable from the rod (301) and may be attached to the rod (301) by having an internally threaded mount on a portion thereof which is designed to interface with the threads of the rod (301). Alternatively, the light source (307) may be permanently attached to the rod (301). In a still further embodiment, and as depicted in FIG. 2, the light source may have a rod component (302*c*) permanently or semi-permanently attached thereto which can be attached when forming the rod (301). In such an embodiment, the rod component (302*b*) may be designed to reverse the connection of other rod components (302). Specifically, the rod component (302*b*) may be designed to have two female (306) or two male (304) (as shown) connectors, one at each end. In this way, the rod components (302) require less variation. The device then may be provided with a selection of rod components including a number of basic spacing components (302), the lighting component (302*b*), and two spiked components (302*a*) each of which may include a similar threaded surface and spiked end (318).

At the first end (313), the rod (301) will be designed to be connected to the lower plate (203). In the embodiment of FIGS. 1 and 2, the connection is simply by placing the rod through the hole (223) in the plate (203). The hole (223) is generally of similar or larger internal diameter to the external diameter of the rod (301) so that the rod passes freely through the hole (223). In this embodiment, there will be attached a nut (303) or similar device which is threaded onto the rod (301) via the threads discussed above which sits below the plate (203). As shown in the depicted embodiment of FIGS. 1 and 2, the nut (303) is preferably of relatively large diameter forming a large cylindrical disk of relatively significant thickness. In the depicted embodiment, the nut (203) has diameter similar to the plate (303) In this way, the end (313) of the rod (301) can be securely engaged to the nut (303) by having sufficient threading to prevent accidental disengagement, while still allowing the resultant lantern (100) to rest on a flat surface. Further, as the nut (303) is not connected to the plate (203), there is no need to rotate the plate (203) to connect it to the rod which can be difficult once the spikes (205) have engaged the pumpkin. The nut (303) may also have the threads formed of a resiliently deformable material to prevent accidental disengagement from unscrewing by performing a generally locking connection.

Figure 3:
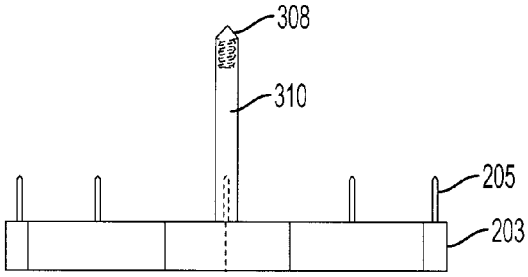
FIG. 3 provides for an alternative embodiment of the base which includes an integral threaded spike.

In an alternative embodiment shown in FIG. 3, the plate (203) or (205) may be permanently attached to the rod (301) or, preferably, a component (310) of the rod (301) as shown in FIG. 3. In such an embodiment, using the handle (305) to drive the rod (301) through the pumpkin shell (101) as discussed below may be impractical. Therefore, in an alternative embodiment, there is provided a removable spike (308) which is designed to engage a mount component (310) of rod (301) attached to the base (203). This spike (308) includes a sharp end which may be driven through the pumpkin shell (101) when the base prongs (205) are engaged. It may then be removed internal to the shell (101) allowing reconnection of the to the remainder of the rod (301) or rod components (302) to the mount component (310).

At the second end (315) of the rod (301) there is attached a handle (305), hook, or similar device which may also include internal threading for attachment to the rod (301). Alternatively, the handle may be permanently attached to the rod (301) or a rod component (320) as shown in FIG. 2.

To create a pumpkin lantern (100) from a pumpkin (101), the user will first carve a jack-o-lantern in any manner from a pumpkin (101) or other vegetable generally cutting an access hole (if needed) into the pumpkin (101) by cutting around the stem (107). The user will then cut or break off the stem (107) of the pumpkin (100) at a point relatively close to the top of the pumpkin (101) lid (105) in the event the device is designed to engage the pumpkin at that position, which is generally intended. The rod (301) may be selected or assembled from rod components (302) may have one or more sharpened ends which can be driven through the lid of the pumpkin, generally through the remaining stem and be threaded through the pumpkin and punched through the base of the pumpkin (101) as contemplated by the design of FIGS. 1 and 2.

Specifically, the handle (305) may be placed on a first end (313) to cover a sharpened end there, the handle (305) can then be held and the second sharpened end (315) can be pushed through the lid (205). Once it is through, the handle can be removed from the first end (313) and placed over the second end (315) with the lid still maintained on the rod (301). The first end can then be pushed through the base of the pumpkin (101) maintaining position by aligning the lid (205) with the remaining shell as the punching occurs. Once completed, the rod (301 extends through the pumpkin shell (101).

In another embodiment, holes may be formed in the top and bottom of the pumpkin (101) using other tools (such as a knife or drill). Alternatively the base (203) using a spike (308) of FIG. 3 may be driven into the bottom of the pumpkin. The spike (308) or a similar one may be removed and used for a similar action utilizing the top plate (201). Regardless of how a hole is formed in the lid (105) and main body (103) of the pumpkin towards its top and bottom points. The holes will be linearly aligned and will represent the top and bottom of the pumpkin and how it is intended to be presented. In a further embodiment, if desired, the lid need not necessarily include the stem, and alternative arrangements of the pumpkin can be obtained.

Returning to the construction of FIGS. 1 and 2, once the holes are formed, the light source (307), if not already, is attached to the rod (301). This may be by building the rod (301) of components (302) of which the light source (307) is one, or by otherwise attaching the light source to the rod (301). The component (302) construction of the rod (301) is particularly desirable because its allow the light source (307) to be easily placed at a variety of heights and allows for the rod to have a variety of lengths to fit in different sized pumpkins with a relatively consistent range of extension form the pumpkin shell (101).

The rod (301) is then placed internal to the pumpkin (101) and extended through the two holes in the pumpkin (101) so as to traverse the height of the pumpkin shell (101) with the light source (307) being suspended inside the pumpkin (101) and having a length within a generally fixed amount extending from both holes in the pumpkin shell (101). The bases (201) and (203), if not already in place, are then placed over the respective holes (223) and (221) being aligned with the holes made in the pumpkin shell by the rod (301) and the rod ends extending from the holes. The prongs (205) on each base (201) and (203) are pointed toward each other and the pumpkin (101). The plates (201) and (203) are then pushed into the pumpkin (101) driving the prongs (205) into the flesh of the pumpkin (101). It is preferred, that the plate (201) be sized and shaped so that few or no prongs (205) hit the stem stump, and at least a couple of prongs (205) penetrate the main body (103) of the pumpkin instead of just the lid (207) based on the expected size of an access necessary to admit a human hand. The rod (301) will pass between the holes (221) and (223) allowing the plates (201) and (203) to pass around the rod (301) and the pumpkin to be assembled with the rod suspended internal the pumpkin shell (101).

Once the plates (201) and (203) are in place, it should be apparent that the rod (301) is effectively trapped inside the pumpkin by the presence of the light source (307) and that the top plate has effectively sealed the lid (205) to the rest of the pumpkin shell (101). The handle (305) is then screwed onto one end of the rod (301) and the nut (303) is placed on the other. These are tightened against each other until the device (200) is sufficiently tight to hold sturdy, while not being tight enough to result in deformation of the shape of the pumpkin (101) (unless such deformation is desired). Generally, if either end is not tight, it will be the top as the top generally does not support the mass of the pumpkin (101). There may also be included a locking washer or similar device on the rod (301) between the plate (201) and (203) and the respective handle (305) or nut (303) to prevent the handle and or nut from unintentionally unscrewing.

It should be recognized that in an alternative embodiment, the plates (201) and (203) may be eliminated and the pumpkin supported entirely on the rod (301) and washer (303). However, this can allow for increased rotation of the pumpkin on the rod (301) and may be undesirable.

In a alternative embodiment of FIG. 3 assembly proceeds slightly differently. The pumpkin is placed directly on the base with the spiked piece (3087) in place simultaneously punching the mounting component (310) through the base of the pumpkin shell (101) as the prongs (205) penetrate the pumpkin shell (101). A similar spike (308) may be attached to the handle (305) to punch the hole for the stem. The rod is then assembled inside the pumpkin (101) connected to the base (203), to which the mounting component (310) is affixed, until it extends through the lid (105). The top plate (201) will generally be connected and held to the top of the pumpkin (101) as discussed above. It is generally preferred that only a single plate (201) or (203) utilize the mounting component (310) to insure that the rod (301) is positioned straight through the pumpkin (101) and correctly aligned with the top (201) and bottom (203) plates.

Once assembled, the pumpkin (101) is illuminated by activating the light source. The activation may take place by activating the source before it is placed in the shell (101), However, in an alternative embodiment, the source (307) may be activated from external the shell (307), either by having electronics built into the rod (301) so that electricity is provided to the light source by activating a switch on the handle (305) and electricity flowing through the rod (301) to the light source (307), or by having the light source (307) have a remote system whereby it may be activated and deactivated once in place. E.g. it may include a small wireless remote or may be activated by an audible signal. Alternatively, the light source may be reached via one of the carvings (109) or may activate on its own based on a photosensor determining it is sufficiently dark that illumination is desired.

Once the lantern (100) is fully assembled and illuminated, it may be carried using handle (305). This allows the jack-o-lantern (101) to actually be used as a lantern. Further, so long as the pumpkin (101) is not overly heavy, it may be carried one-handed or used as a prop. Alternatively, the handle (305) may be used to hang the pumpkin from a structure to create a hanging decoration, if desired. As the pumpkin (101) is held between the plates (201) and (203), it will allow for the handle (305) to be used to easily carry the pumpkin (101) which now has significant structure and support imparted by the rod (301) and plates (201) and (203) which extend generally along the line of gravity when the device (200) is supported by the handle. Further, the flat base of the nut (303) or base (203) allows for the pumpkin lantern to be set down on a flat surface if necessary.

Generally, as the rod (301) will extend through the center of mass of the pumpkin shell (101) so it will easily not tip over. To improve this, the nut (303) may be given a significant weight so as to lower the center of mass of the pumpkin lantern (100), however, this can increase the weight of the entire lantern (100) and can be undesirable if the lantern is intended to be carried.

The transport device (200) may be made out of a variety of materials including, but not limited to, high impact plastic or metal. The transport device may also be made in a variety of sizes so as to accommodate pumpkins (101) of different sizes. Alternatively, the rod (301) may be formed as pieces (302) allowing for a variety of sizes as discussed. The plates (201) and (203) may also be of adjustable size such as by being expandable to accommodate pumpkins of different sizes or shapes.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A device for the hand transport of plant matter, the device comprising:

a plate;

a rod extending from said plate; and a handle connectable to said rod;

wherein said plate is mounted on said rod such that said rod extends through plant matter resting on said plate; and wherein said handle is attached to said rod so as to place said plant matter between said plate and said handle.

2. The device of claim 1 wherein said handle screws onto said rod.

3. The device of claim 1 further comprising a second plate, said second plate being placed such that said second plate is between said handle and the plant matter when the plant matter rests on said plate.

4. The device of claim 3 wherein at least one of said plate and said second plate includes one or more prongs which extend into the plant matter when the plant matter rests on said plate.

5. A device for illuminating a jack-o-lantern, the device comprising:

a jack-o-lantern;

a bottom plate;

a rod extending from said bottom plate; and a directionally-oriented light source attached to said rod;

wherein said bottom plate is mounted on said rod such that said rod extends into said jack-o-lantern when said jack-o-lantern rests on said bottom plate; and wherein said directionally-oriented light source directs light through a face of said jack-o-lantern.

6. The device of claim 5 further comprising a handle.

7. The device of claim 6 wherein said handle screws onto said rod.

8. The device of claim 6 wherein said handle attaches to said top plate.

9. The device of claim 6 wherein said handle can be used to hang said jack-o-lantern from an object indefinitely.

10. The device of claim 5 wherein said bottom plate includes one or more prongs which extend into said jack-o-lantern.

11. The device of claim 5 wherein said light source comprises one or more Light Emitting Diodes (LEDs).

12. A method for illuminating a jack-o-lantern, the method comprising:

providing a jack-o-lantern;

providing a mounting system, said mounting system comprising:

a bottom plate;

a top plate;

rod attachable to said top plate and said bottom plate;

providing a light source connectable to said rod;

placing said jack-on-lantern on said mounting system such that said jack-o-lantern is between said top plate and said bottom plate and said rod extends through the interior of said jack-o-lantern;

connecting said light source to said rod inside said jack-o-lantern;

illuminating said jack-o-lantern with said light source.

13. The method of claim 12, wherein the method further comprises:

providing a carrying means attachable to said rod;

attaching said carrying means to said rod;

carrying said jack-o-lantern.

14. The method of claim 13 wherein said carrying means screws onto said rod.

15. The method of claim 13 wherein said carrying means attaches to said top plate.

16. The method of claim 13 wherein said carrying means is a handle.

17. The method of claim 13 wherein said carrying means can be used to hang said jack-o-lantern from an object indefinitely.

18. The method of claim 12 wherein said light source comprises one or more Light Emitting Diodes (LEDs).

* * * * *